United States Patent [19]

Hedstrom

[11] 4,167,883

[45] Sep. 18, 1979

[54] FIXTURE FOR SAWING MITERED MEMBERS

[76] Inventor: Robert E. Hedstrom, 4326 Taylor Ave., Racine, Wis. 53405

[21] Appl. No.: 901,496

[22] Filed: May 1, 1978

[51] Int. Cl.[2] ..... B27B 27/06

[52] U.S. Cl. ..... 83/468; 83/471.2; 83/485; 83/581

[58] Field of Search ..... 83/468, 471.2, 486.1, 83/485, 581, 477.2, 522

[56] References Cited

U.S. PATENT DOCUMENTS

| | | | |
|---|---|---|---|
| 3,209,798 | 10/1965 | Coleman | 83/485 |
| 3,348,591 | 10/1967 | Carrasco | 83/471.2 |
| 3,812,751 | 5/1974 | Lewis | 83/581 |
| 4,024,783 | 5/1977 | Sturgis | 83/468 |

*Primary Examiner*—Donald R. Schran
*Attorney, Agent, or Firm*—Axel H. Johnson

[57] ABSTRACT

A fixture to be mounted on the table of a radial-type circular saw to enable the accurate and convenient sawing of the joints of complementary adjoining members of picture frames and other mitered frames. This fixture permits the sawing of the adjoining members of a frame without necessitating a re-setting of the angular position of the saw for each end of the frame members, thus avoiding angular errors; the fixture remaining undisturbed relative to the saw during the sawing of the ends of each of the members.

2 Claims, 9 Drawing Figures

FIXTURE FOR SAWING MITERED MEMBERS

BACKGROUND OF THE INVENTION

1. Field of the Invention

This invention relates to a fixture to be fixedly mounted on the table of a radial-type of circular saw to permit the sawing of the corresponding ends of the complementary members of a frame.

2. Description of the Prior Art

The prior art necessitates the changing of the angular position of the saw for sawing the complementary ends of the members of a frame, with the possibility of angular errors resulting because of the change.

SUMMARY OF THE INVENTION

The invention comprises a fixture to be mounted on the table of a radial saw with the angular setting of the saw remaining undisturbed during the sawing of both ends of the abutting members of the frame; thus assuring an accurate angular relationship between the adjoining members when assembled.

One object of this invention is to provide a fixture to be secured to the table of a radial saw that assures the sawing of both ends of a frame member at identical angles.

Another object is to avoid the necessity of angular repositioning of the saw when sawing the complementary ends of a frame.

Further objects and advantages of the invention will become apparent from a consideration of the detailed description taken in connection with the accompanying drawings wherein an embodiment of the invention is shown.

Referring to the drawings.

Figure 1:
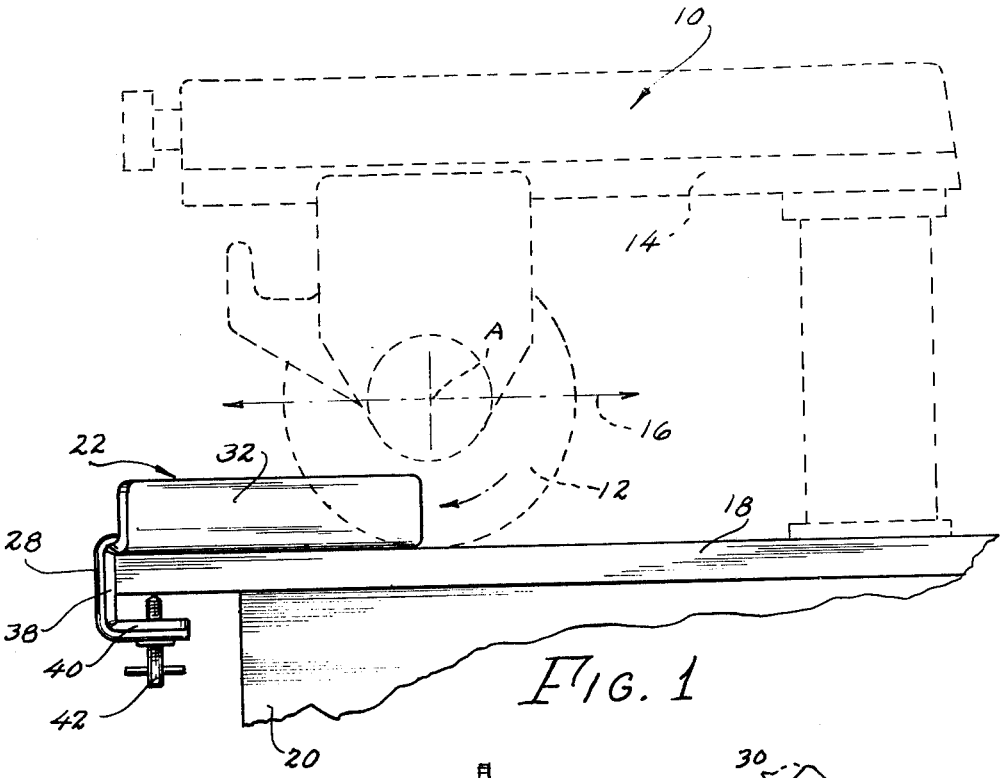
FIG. 1 is a vertical side-view, in dotted lines, of a typical radial saw in conjunction with the customary saw table and with the fixture of this invention in place thereon.
Figure 4:
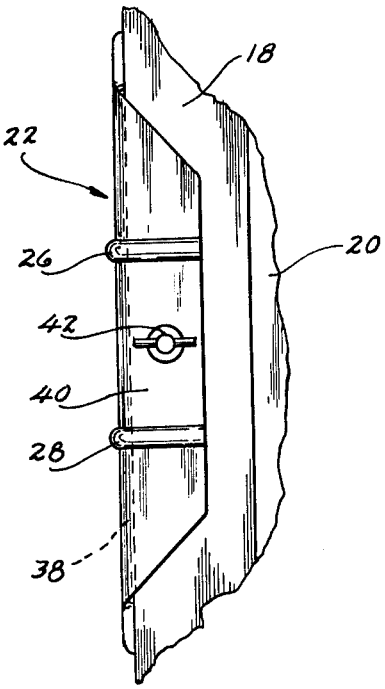
FIG. 4 is a view directed upwardly toward the underside of the table of FIG. 1, and showing the means of securing the fixture to the table.

Referring again to FIG. 1, the radial saw 10, not an element of this invention, is typical and includes a saw disk 12 having an axis A which saw assembly is mounted on a beam 14 so as to be shiftable horizontally in the direction of arrow 16. Saw disk 12 rotates in a plane perpendicular to the surface of table 18 which is of material not apt to injure the saw disk 12. Table 18 is supported upon the usual stand or table 20.

Figure 3:
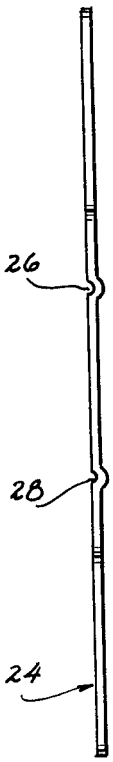
FIG. 3 is an end-view of the blank of FIG. 2.
Figure 2:
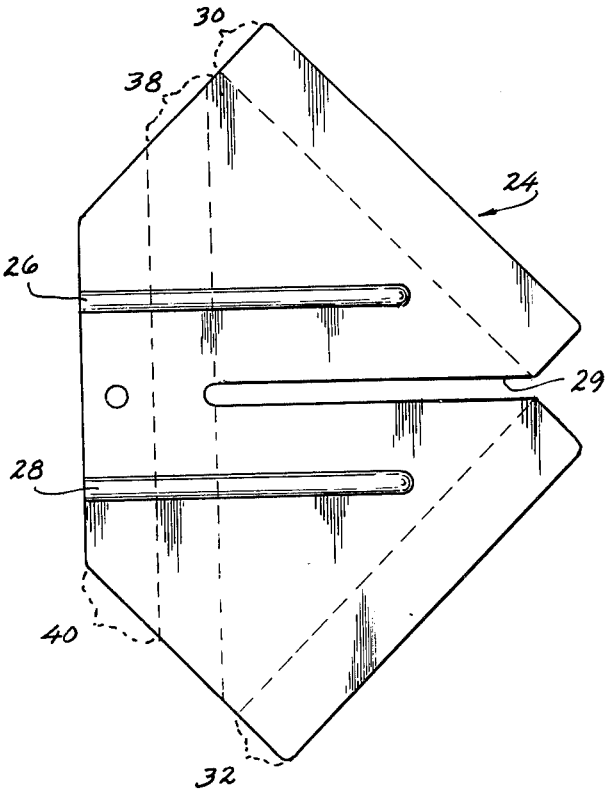
FIG. 2 is a plan view of the blank of the fixture prior to being formed.
Figure 6:
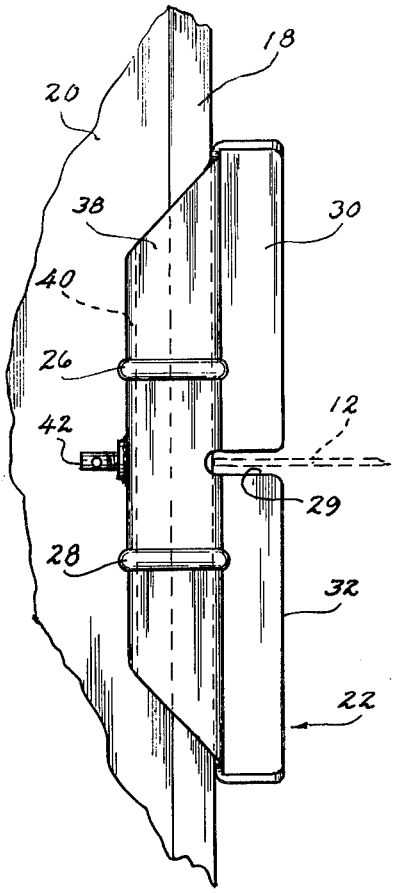
FIG. 6 is a front view in elevation, of the fixture of FIG. 5.

The mitering fixture 22 of this invention comprises a blank 24 of sheet metal and of the shape shown in FIGS. 2 and 3, and of a suitable thickness. Ribs 26 and 28 serve as a means of providing rigidity to the fixture against distortion when it is mounted upon the table 18. A slot 29 is provided to permit entrance of the saw disk 12.

Figure 5:
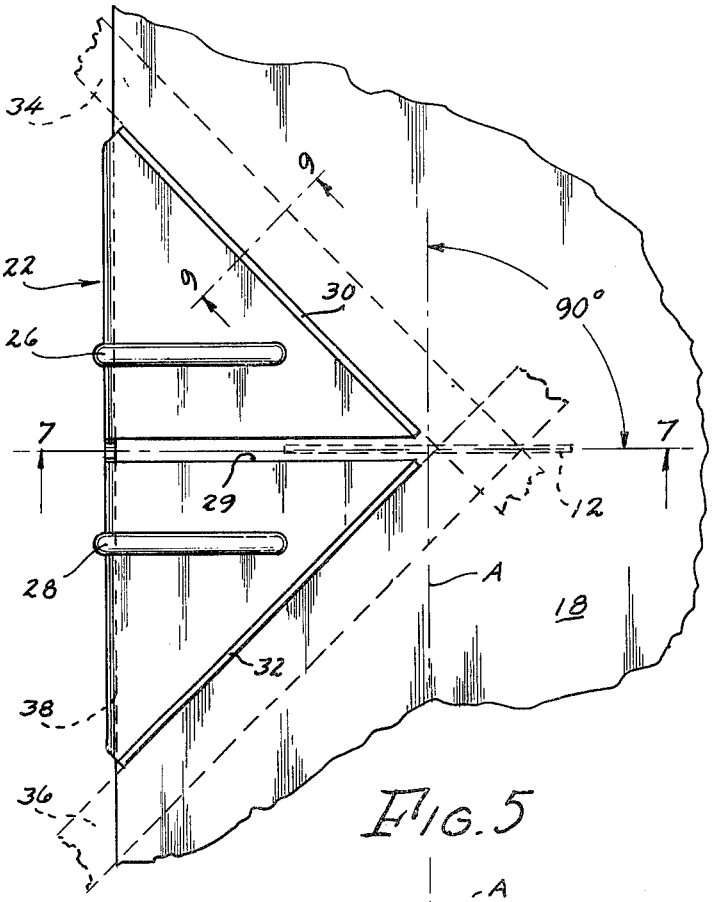
FIG. 5 is a plan view of the complete fixture in place on the table of the saw and showing frame members in dotted lines positioned preparatory to being sawed.
Figure 7:
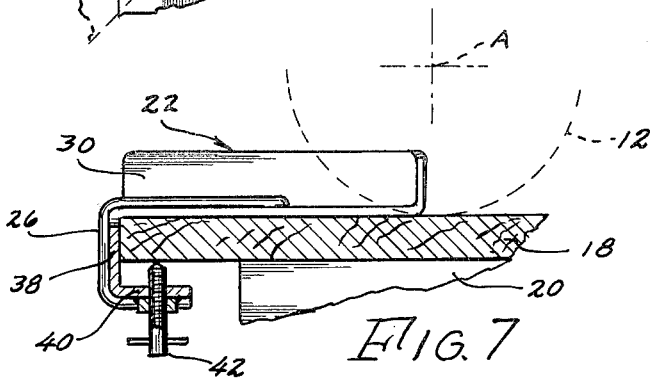
FIG. 7 is a section taken at 7—7 of FIG. 5.
Figure 8:
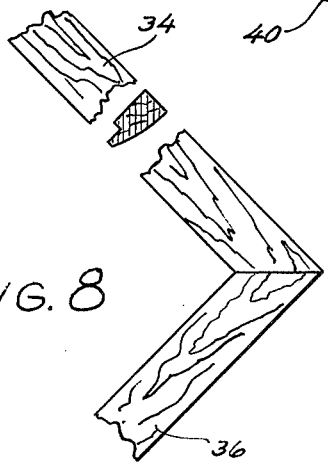
FIG. 8 is a typical frame showing the joint resulting from the use of the present mitering fixture.

The completed fixture 22 comprises upright walls 30 and 32 formed as shown, which walls serve to provide guides for the frame members 34 and 36 when the latter are being sawed. In this instance walls 30 and 32 define an isosceles triangle of 90 degrees between them so as to provide complementary angles of 45 degrees for each member as indicated in FIG. 5. An upright wall 38 is directed downwardly and abuts the front edge of table 18. Wall 38 terminates in a horizontal portion 40 which extends under table 18. A member 42 having threaded engagement with portion 40 provides a means of securing the fixture to the surface of table 18, and in engagement with the front edge thereof. The fixture is positioned so as to permit saw disk 12 to enter slot 29 and parallel thereto during the sawing operation.

If it is desired to construct frames having six members, walls such as 30 and 32 would be positioned so as to subtend an angle of 120 degrees between them; the process of sawing would then be identical to that embracing a 90 degree angle, or four members.

Figure 9:
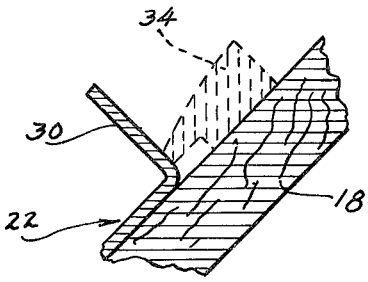
FIG. 9 is an enlarged view of a portion taken at 9—9 of FIG. 5.

When preparing a picture frame using this fixture, the member 34 of picture frame material is placed as shown in FIGS. 5 and 9, in abutment with wall 30, and saw disk 12 is advanced into slot 29 to saw one end of the member. The other end of member 34 is then placed in abutment with wall 32 and saw disk 12 is then advanced forwardly to saw the other end of the member. This operation is repeated with respect to all frame members; care being taken that the opposed members of the frame are of equal length.

I claim:

1. A mitering fixture for sawing complementary ends of abutting frame members, said fixture being positioned upon the surface of the table of a radial disk saw, said table having a front edge parallel to the axis of said disk, and a surface normal to the plane of said disk, said disk rotatable about said axis and shiftable tangentially above said surface normal to said front edge; said fixture comprising a panel resting upon said surface and defining an isosceles triangle, the base of said triangle being parallel to and adjacent said front edge, the apex of said triangle corresponding to the plane of said disk, and the bisector of said triangle being normal to said edge, said panel having fixed integral upwardly-extending dual and opposed walls converging toward said apex and terminating in a gap intermediate said walls to permit passage of said disk therebetween, said panel having integral therewith a downwardly-directed wall engaging said front edge, and means integral with said wall to secure said fixture to said table.

2. A mitering fixture as set forth in claim 1, in which said panel is provided with a slot coincidental with said bisector.

* * * * *